US005810088A

United States Patent [19]

Lamirand et al.

[11] Patent Number: 5,810,088

[45] Date of Patent: Sep. 22, 1998

[54] ELECTRICALLY ACTUATED DISCONNECT APPARATUS AND METHOD

[75] Inventors: Brad Lamirand, Sugar Land; William C. Herben, Houston, both of Tex.

[73] Assignee: Baker Hughes, Inc., Houston, Tex.

[21] Appl. No.: 825,014

[22] Filed: Mar. 26, 1997

[51] Int. Cl.[6] ..... E21B 23/04

[52] U.S. Cl. ..... 166/377; 166/242.6; 166/66.4

[58] Field of Search ..... 166/65.1, 66.4, 166/53, 377, 381, 373, 242.6

[56] References Cited

U.S. PATENT DOCUMENTS

| | | | |
|---|---|---|---|
| 4,200,297 | 4/1980 | Tricon | 277/102 |
| 4,375,237 | 3/1983 | Churchman | 166/117 |
| 4,391,547 | 7/1983 | Jackson, Jr. et al. | 403/341 |
| 4,535,842 | 8/1985 | Ross | 166/63 |
| 4,596,293 | 6/1986 | Wallussek et al. | 175/45 X |
| 4,676,306 | 6/1987 | Russell | 166/323 X |
| 4,749,044 | 6/1988 | Skipper et al. | 166/323 |
| 4,760,879 | 8/1988 | Pringle | 166/323 X |
| 5,050,682 | 9/1991 | Huber et al. | 166/377 |
| 5,133,412 | 7/1992 | Coronado | 166/381 |
| 5,257,663 | 11/1993 | Pringle et al. | 166/66.4 |
| 5,323,853 | 6/1994 | Leismer et al. | 166/55 |

*Primary Examiner*—Roger J. Schoeppel

*Attorney, Agent, or Firm*—J. Nevin Shaffer, Jr.; Shaffer & Culbertson

[57] ABSTRACT

In drilling equipment having at least one remote assembly (62) attached to a drill string (12), an electrically actuated disconnect apparatus and method (10) for releasing the remote assembly (62) has an electric signal transmitter electrically connected to a release device (16). The release device (16) operates a retaining device (22) holding strainer blocking devices (24) therein. A strainer (56) is connected to the drill string (12) after the retainer (22) and through which drilling fluid flows until blocked by the strainer blocking devices (24). A one way pressure relief mechanism (34) is provided in the drill string (12) conformed to operate when the flow of drilling fluid is continued after the strainer (56) is blocked by the strainer blocking devices (24) so that drilling fluid is allowed to impact against a movable piston (44), the moveable piston (44) conformed to the drill string (12), and movable to apply pressure to move a disconnect shift tube (52) so as to shift the disconnect shift tube (52) and release a coupling key (32), thereby releasing the remote assembly (64) from the drill string (12).

13 Claims, 7 Drawing Sheets

ELECTRICALLY ACTUATED DISCONNECT APPARATUS AND METHOD

BACKGROUND OF THE INVENTION

This invention relates to an improved disconnect apparatus and method for releasing remote assemblies from drilling conduit. More particularly, this invention relates to an electrically actuated disconnect apparatus and method for releasing remote assemblies attached to a drill string.

As occurs in situations involving drilling equipment, it sometimes becomes necessary to remove remote assemblies attached to drilling conduit in order to retrieve the conduit if the remote assembly has become stuck or inoperative for any reason. A variety of mechanisms are known in the art for removing stuck drilling assemblies including shear devices such as disclosed in U.S. Pat. No. 5,070,941. Another mechanism requires the use of separate hydraulic control lines in conjunction with an electric cable inside the drill string, such as disclosed in U.S. Pat. No. 5,323,853, so as to apply increased hydraulic pressure by means of the hydraulic flow line to cause separation of the remote assembly. Additionally, U.S. Pat. No. 5,323,853 discloses the use of an electrical line which activates a detonator which in turn detonates an explosive charge which then acts upon an actuating means which includes a piston which moves a sleeve upwardly and releases locking dogs, thereby releasing the remote assembly.

A drawback to the electrically actuated disconnect devices known in the art is that once disconnection procedures are commenced, no further electrical contact with the remote assembly is possible. Further, there are safety and reliability issues raised by the use of explosives. Prior art devices suffer from these drawbacks and the heretofore complex and intricate designs necessary to effectuate them. Thus, there is a need in the art for providing an electrical disconnect which is safe to use, and which allows, even after commencing disconnect procedures, additional communication with the remote bottom hole assembly as may be deemed necessary. It, therefore, is an object of this invention to provide an improved electrical disconnect apparatus and method for simply, and safely, disconnecting remote bottom hole assemblies while, if desired, maintaining the ability to communicate with the remote bottom hole assembly even after the electrical signal commencing the disconnect procedure has been sent.

SHORT STATEMENT OF THE INVENTION

Accordingly, the safety system for electrically disconnecting remote assemblies in drilling equipment having remote assemblies attached to a drill string includes an electrical signal transmitter for transmitting an electric signal to an electrically actuated release, such as a solenoid. The solenoid is connected to a retainer which holds strainer blocking devices such as plastic and/or metal balls. A strainer is connected to the drill string, after the ball retaining device, through which drilling fluid flows. A one way pressure relief device is located in between the ball retainer and the strainer and is conformed to operate when the flow of drilling fluid is continued after the strainer is blocked by the balls. Once activated, a burst piston forces a ram to cause a shear pin to shear thereby allowing the drilling fluid to flow into an annulus and be forced against a movable piston. The movable piston is conformed to the drill string and is moveable by the drilling fluid to apply pressure to move a disconnect shift tube so as to shift the disconnect shift tube and release a coupling key, thereby effectuating the release of the remote assembly from the drill string. The invention is safe in that, for example, it operates in only one direction since if pressure is applied from the annulus, the burst piston shoulders against an outer piston housing and prevents operation of the disconnect. Also, it involves no explosives and enables the user to communicate with the bottom hole assembly even after the signal to release the balls has been sent. This is done by stopping the flow of drilling fluid so that no over pressure is created on the one way pressure relief device. As a result, the user can continue use of the remote bottom hole assemblies and communicate with them without uncoupling them as long as is feasible. Once it is determined that uncoupling is the only solution, a safe, simple means of uncoupling is achieved by the invention by simply restarting the flow of drilling fluid.

The method for electrically disconnecting remote assemblies attached to a drill string includes the step of providing a means for transmitting an electrical signal from the surface through the drill string to the remote assembly. An electrically actuated release means is connected within the drill string to a retainer of strainer blocking devices. A strainer is connected within the drill string through which drilling fluid is capable of flowing. In between the strainer and the release device, a one way pressure relief device is provided within the drill string guarding access of the drilling fluid to an annulus and a movable piston. Once the signal has been sent from the electrical signal transmitting device to the electrically actuated release device, such as a solenoid, the retainer is operated to release the strainer blocking devices, balls, into the drilling fluid. The user can then stop the flow of drilling fluid and allow the balls to fall or float into the strainer. At this point, the user still has the ability to electrically contact the remote assembly as necessary and appropriate. Thereafter, once it is determined that disconnection is necessary, drilling fluid is once again pumped into the drill string, thereby causing back pressure to move a burst piston so as to force a ram radially outward from the tool which in turn causes a shear pin to be put in shear between the ram and a shear plate. The shearing of the shear pin allows drilling fluid to escape into the annulus and to impact the movable piston. The moveable piston is in moveable relationship to a disconnect shift tube, holding a coupling key in place. The movement of the piston moves the disconnect shift tube allowing the coupling key to fall away, thereby releasing the remote assembly from the drill string.

BRIEF DESCRIPTION OF THE DRAWINGS

Other objects, features, and advantages of the present invention will become more fully apparent from the following detailed description of the preferred embodiment, the appended claims and the accompanying drawings in which:

DETAILED DESCRIPTION OF THE PREFERRED EMBODIMENT

Figure 1A:
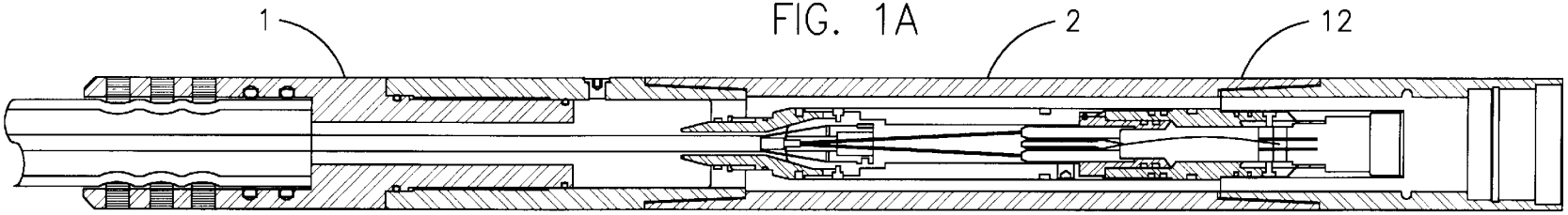
FIGS. 1A, 1B, and 1C form a cross-sectional view of a preferred embodiment of the electrical disconnect mechanism of the present invention.
Figure 1B:
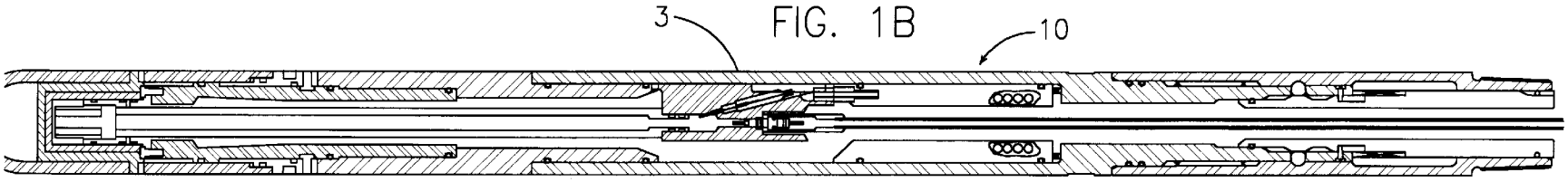
Figure 1C:
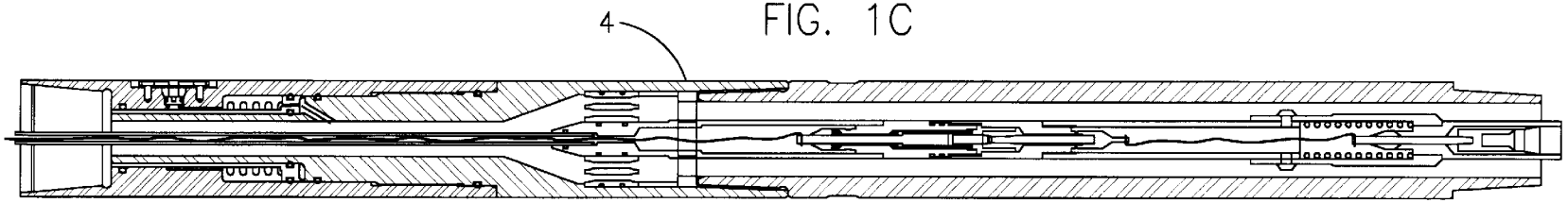
Figure 2:
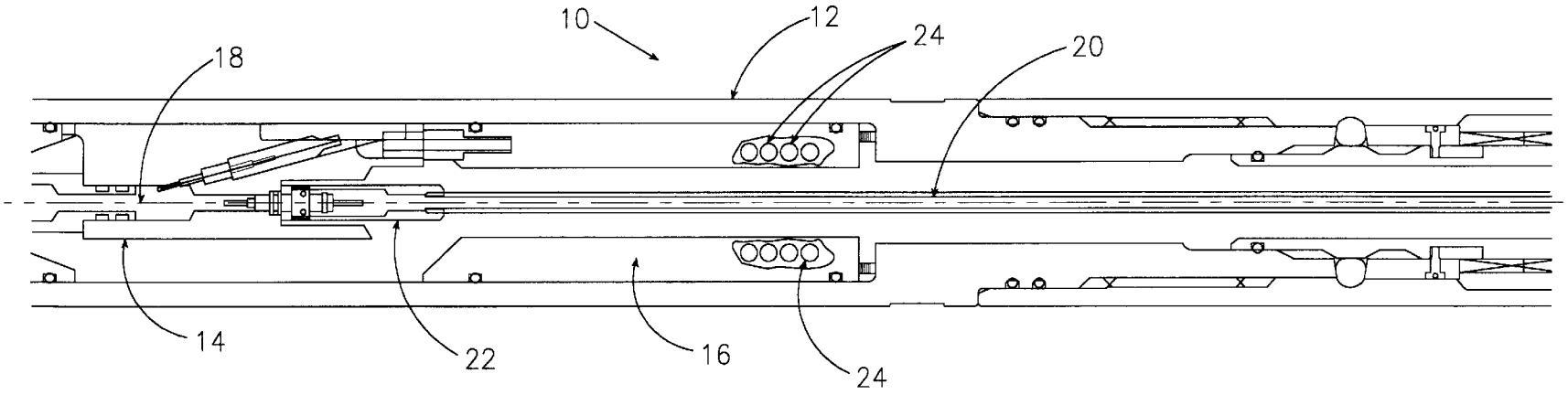
FIG. 2 is an expanded view of the solenoid and retaining sleeve of the present invention.
Figure 3:
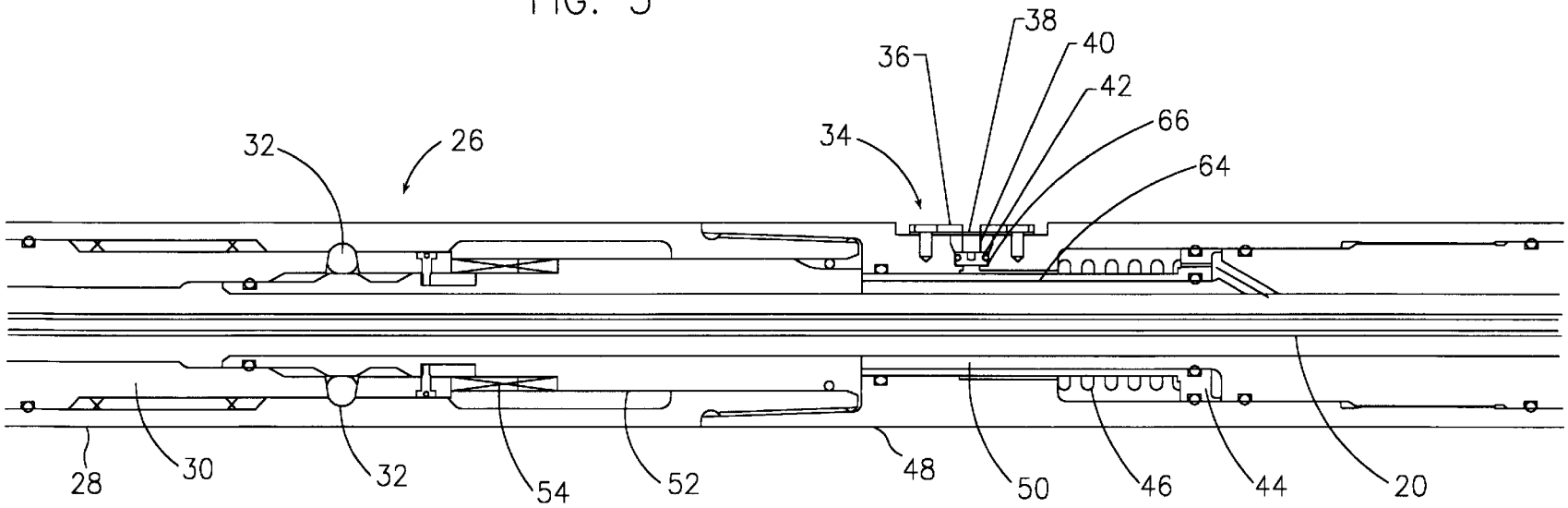
FIG. 3 is an expanded view of the coupling housing and disconnect coupling keys, and rupture disc.
Figure 4:
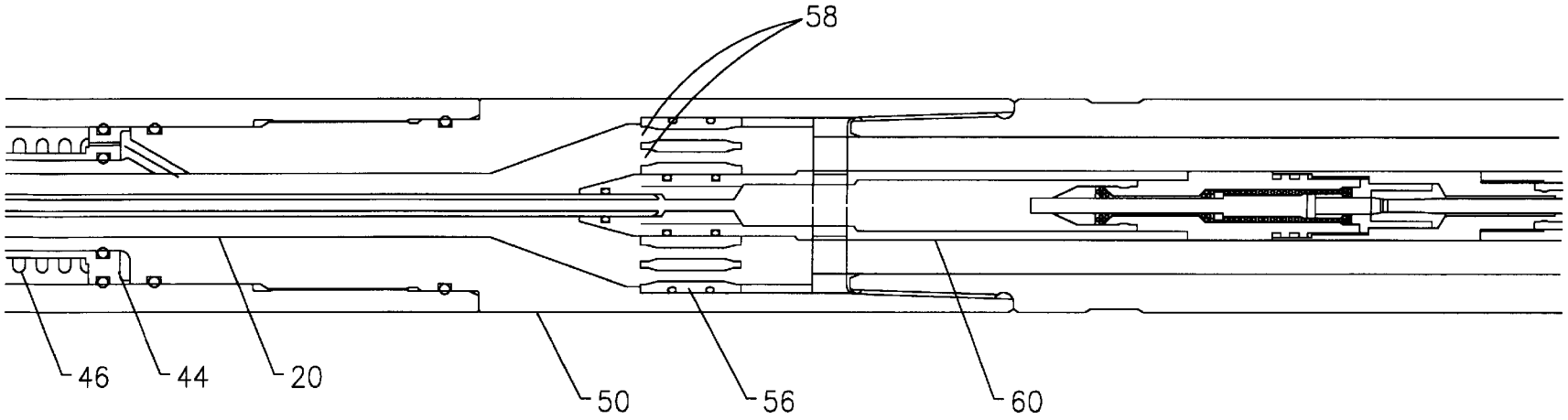
FIG. 4 is an expanded view of the strainer of the present invention.

The preferred embodiment of the present invention is illustrated by way of example in FIGS. 1 through 6. First, referring to FIGS. 1A, 1B, and 1C, FIG. 1A illustrates coiled tubing connector 1 and cable head assembly 2 for the electric disconnect 10 of the present invention. FIG. 1B illustrates the solenoid disconnect sub-assembly 3, discussed more fully hereafter, and FIG. 1C illustrates the disconnect pressure relief sub-assembly 4, also discussed and disclosed more fully hereafter. With specific reference to FIGS. 2, 3, and 4, an electrical disconnect 10 is provided to drill string 12 by means of solenoid locator 14, holding solenoid 16 in place. Solenoid 16 is connected to an electrical signal generator, such as a DC power supply, on one end by an electrical wire 18. Electrical wire 18 also passes through solenoid 16 within wire protection tube 20. Solenoid 16 is connected thereby to retaining sleeve 22 which retains at least one strainer blocking means, such as a metal or polypropylene ball 24. Moving from left to right, top to bottom, in the drill string, next in line is the remote bottom hole assembly housing 26. Remote bottom hole assembly housing 26 includes outer coupling housing 28 and inner coupling housing 30 and coupling key 32. Also shown is a one way pressure relief valve 34, including burst plate 36, shear pin 38, ram 40 and burst piston 42. The combination of these items acts as a one way pressure relief mechanism. When enough back pressure builds up behind the burst piston 42 (caused when the balls released from the solenoid 16 plug the strainer 56 and flow is applied to the system), the ram 40 is forced radially outward from the tool, which in turn causes the shear pin 38 to be put in shear between the ram 40 and the burst plate 36. The shearing of the shear pin 38 allows flow to escape into the annulus 64. Pressure relief valve 34 acts in one direction only because if pressure is applied from the annulus 64, the burst piston 42 shoulders against outer piston housing 66. This is the reason why this mechanism is used in place of a standard rupture disk; so it can operate in much higher reverse pressure conditions. Also shown are piston 44, compression spring 46, outer piston housing 48, and inner piston housing 50. When the fluid is allowed to flow into the annulus 64, the flow differential past the piston 44 forces it to travel up. The mechanism, known in the art, by which the piston 44 is moved is by a small orifice in its flange which acts as a flow restrictor. The pressure built up as the fluid is pumped through the tool and diverted through this orifice causes the piston to shift. The outer piston housing 48 and the inner piston housing 50 act to create a localized chamber where pressure can build up in order to move the piston 44. The compression spring 46 functions to cause the piston 44 to stay in its normal position and not vibrate during normal drilling operation. Additionally, disconnect shift tube 52 and compression spring 54 are illustrated. When the piston 44 is forced to shift, it in turn forces the disconnect shift tube 52 up. This enables the coupling keys 32 to fall radially inward, thereby uncoupling the inner coupling housing 30 from the outer coupling housing 28 and allowing disconnection of the tool. The compression spring 54 assures that the disconnect shift tube 52 will not move prematurely and allow undesired disconnection.

Again, moving left to right in the drill conduit, next in line is the strainer 56, with at least one strainer hole 58 through which drilling fluid ("mud") is capable of flowing. Electrical wire 18 enclosed in wire protection tube 20 passes through strainer by means of strainer feed through 60.

Figure 5:
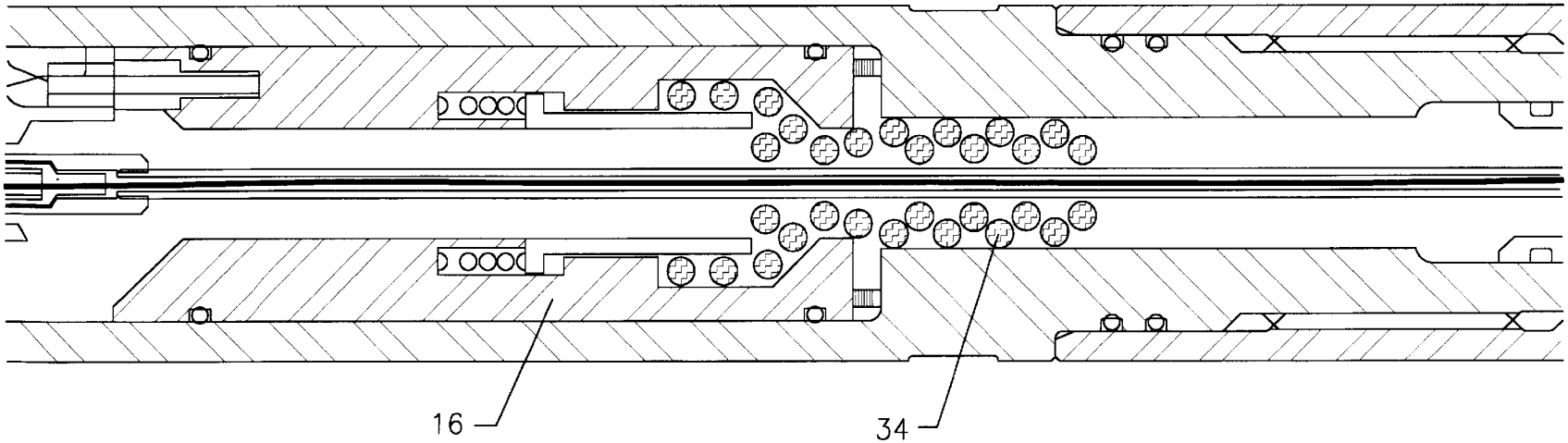
FIG. 5 shows the solenoid actuated and the balls released.
Figure 6A:
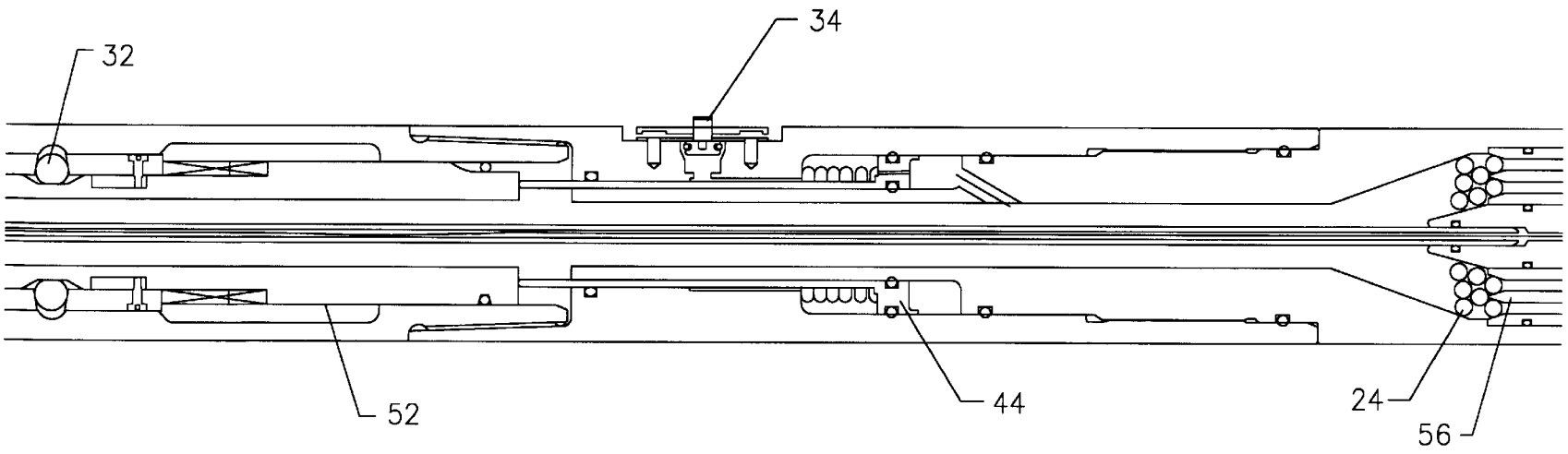
FIG. 6A shows the balls plugging the strainer, the pressure relief valve moved, the piston moved, the disconnect shift tube shifted and the coupling keys released.

Referring now to FIGS. 5 and 6, FIG. 5 shows the solenoid 16 having been actuated so that balls 24 are released (FIG. 5) and, ultimately, plug strainer 56 (FIG. 6A). As also shown in FIG. 6A, as a result of balls 24 plugging strainer 56, the pressure relief mechanism 34 is activated so that piston 54 is shifted, shifting disconnect shift tube 52 thereby releasing coupling keys 32.

Figure 6B:
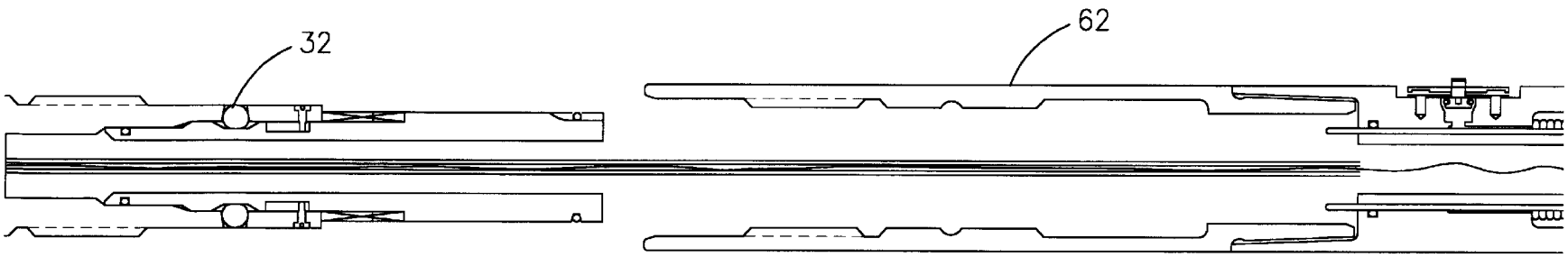
FIG. 6B shows the remote assembly released from the drill string.

Referring to FIG. 6B, it is shown, as a result, where remote bottom hole assembly 62 is released from drill string 12.

In operation, a user determines the moment at which it is appropriate to send an electrical signal to electrical disconnect 10 by means of a signal generator, of any type known in the art and not disclosed more fully hereafter, through an electrical wire 18 to solenoid 16. Upon receipt of an appropriate electrical signal, solenoid 16 moves retaining sleeve 22 so that balls 24 fall or float into drilling mud within drill string 12. The balls 24 fall or float past inner and outer coupling housing 28 and 30 and coupling key 32, past one way pressure relief means 34 and into strainer 56. At this point, the user has effectuated the first step in safely disconnecting a remote bottom hole assembly 62. Nonetheless, electrical connection to remote bottom hole assembly 62 is still maintained by means of electrical wire 18 within wire protection tube 20 all the way to remote bottom hole assembly 62.

Once a decision by the user has been made to complete the electrical disconnect of the bottom hole assembly, the user simply begins to pump drilling fluid again into drill string 12. The drilling fluid impacts strainer 56 which has now been blocked by balls 24 and the resulting overpressure results in operating one way pressure relief means 34. Upon actuating one way pressure relief means 34, drilling fluid enters annulus 64 and moves piston 44 which in turn moves disconnect shift tube 52 allowing coupling key 32 to fall into the recess in disconnect shift tube 52 as illustrated in FIG. 6. Once this happens, inner coupling housing 30 and outer coupling housing 28 are uncoupled and remote bottom hole assembly 62 is released. Drill string 12 may then be safely removed.

In another embodiment, electrical wire 18 to solenoid 16 is replaced by an unattached signal transmitting device of any type known in the art capable of transmitting an electrical signal. In this embodiment then, all that is necessary to start the disconnect procedure is to send the signal to the solenoid 16 from the transmitting device held on the surface. The operation of the invention remains the same other than that modification as more fully set forth above.

The strainer 56 and the strainer blocking devices 24 may be of any known or imagined combination. That is, it may be that strainer 56, for whatever reason, performs most satisfactorily with a single, large pass through for the drilling fluid. In that event, at a minimum, at least one strainer blocking device could be utilized to block the strainer. On the other hand, it may be that the strainer 56 has a plurality of strainer holes 58 in which case, many more than one ball 24 would be utilized. In the preferred embodiment, the balls are ¼ inch in diameter Delrin balls and/or ¼ inch diameter polypropylene balls. In a preferred embodiment, fifty percent of the balls are Delrin and fifty percent are polypropylene, although any suitable dense and light material can be chosen, so long as some are denser than water and some are lighter than water. This requirement ensures that no matter what the orientation of the tool when the balls are released, that the balls will either float or fall into the strainer 56 on their own.

While the disconnect system of the present invention has been disclosed in connection with use with drilling conduit, in particular drill strings for drilling wells, it should be appreciated that the disconnect system can be used in other drilling situations as well, such as coiled tubing, and any other directional drilling systems wherein a remote assembly is attached to a drilling conduit. The present invention provides an improved disconnect system which can be easily manipulated in order to effectuate disconnection of a remote bottom hole assembly. The method and mechanism is simple and reliable and enables a continued communication with the remote assembly even after the commencement of the disconnect procedure. Thus, the disconnect mechanism of the present invention has the important advantage of providing a safety means to the operator thereof.

While the present invention has been disclosed in connection with the preferred embodiment thereof, it should be understood that there may be other embodiments which fall within the spirit and scope of the invention as defined by the following claims.

We claim:

1. In drilling equipment having at least one remote assembly attached to a drill string, an electrically actuated disconnect apparatus for releasing said remote assembly comprising:

(a) a means for transmitting an electric signal;

(b) an electrically actuated release means;

(c) at least one strainer blocking means retained by said electrically actuated release means until receipt of said electric signal so that said strainer blocking means is released into a flow of drilling fluid;

(d) a strainer through which said drilling fluid flows until blocked by said strainer blocking means; and (e) a one way pressure relief means in said drill string conformed to operate when the flow of drilling fluid is continued after said strainer is blocked by said strainer blocking means so that drilling fluid releases said remote assembly from said drill string.

2. The apparatus of claim 1 wherein said means for transmitting an electric signal is a shielded electrical wire.

3. The apparatus of claim 1 wherein said means for transmitting an electric signal is an electrical signal transmitting means not directly electrically connected to said electrically actuated release means.

4. The apparatus of claim 1 wherein said electrically actuated release means is a solenoid.

5. The apparatus of claim 1 wherein said strainer blocking means is a plurality of sphere shaped balls conformed to block said strainer with more than one hole.

6. The apparatus of claim 1 wherein the strainer blocking means is a combination of balls, some of which are denser than water and some of which are lighter than water.

7. The apparatus of claim 1 wherein the one way pressure relief means further comprises a moveable piston, said moveable piston conformed to said drill string and moveable to apply pressure to move a disconnect shift tube so as to shift said disconnect shift tube and release a coupling key, thereby releasing said remote assembly.

8. In drilling equipment having at least one remote bottom hole assembly attached to a drill string by means of an inner and outer coupling housing, coupled together by means of a coupling key, through which drilling fluid is controllably pumped, an electrically actuated quick disconnect apparatus for releasing said remote bottom hole assembly comprising:

(a) an electrical wire with two ends, connected at a first end to a signal generator and at a second end to said remote bottom hole assembly;

(b) an electrically operated solenoid connected between said first and second ends of said electrical wire;

(c) a ball retainer connected to said solenoid for retaining balls conformed to plug a strainer, when released into drilling fluid;

(d) said strainer connected to said drill string, through which drilling fluid flows when pumped; and (e) a one way pressure relief means in said drill string conformed to operate when the flow of drilling fluid is continued after said strainer is blocked by said balls so that drilling fluid is admitted to an annulus where it is forced against a moveable piston, said moveable piston conformed to said drill string and moveable to apply pressure to move a disconnect shift tube so as to shift said disconnect shift tube and release said coupling key, thereby releasing said remote bottom hole assembly from said drill string.

9. For drilling equipment having at least one remote assembly attached to a drill string, an electrically actuated disconnect method for releasing said remote assembly comprising the steps of:

(a) providing a means for transmitting an electric signal;

(b) connecting an electrically actuated release means within said drill string to a retainer of strainer blocking means;

(c) connecting a strainer within said drill string through which said drilling fluid flows;

(d) providing a one way pressure relief means in said drill string in between said retainer and said strainer;

(e) providing a moveable piston conformed to said drill string in movable relationship to a disconnect shift tube holding a coupling key in place;

(f) transmitting an electric signal from said means for transmitting an electric signal to said electrically actuated release means so that at least one strainer blocking means is released from said retainer; and (g) continuing introduction of drilling fluid into the drill string after said strainer is blocked, so that said one way pressure relief means operates allowing drilling fluid into an annulus so as to move said moveable piston against said disconnect shift tube, thereby disengaging said coupling key and releasing said remote assembly from said drill string.

10. The method of claim 9 whereby the step of providing a means for transmitting an electric signal comprises the step of connecting a shielded electrical wire on one end to a signal transmitting device and on the other end to said electrically actuated release means.

11. The method of claim 9 wherein the step of connecting an electrically actuated means to said drill string comprises the step of connecting a solenoid to said drill string.

12. The method of claim 9 wherein the step of providing at least one strainer blocking means comprises the step of providing a plurality of sphere shaped balls conformed to block a strainer with more than one hole.

13. For drilling equipment having at least one remote bottom hole assembly, through which drilling fluid is controllably pumped, attached to a drill string by means of an inner and outer coupling housing, coupled by means of a coupling key, an electrically actuated quick disconnect method for releasing said remote bottom hole assembly comprising the steps of:

(a) connecting an electrical wire, with two ends, at a first end to a surface signal generator and at a second end to said remote bottom hole assembly;

(b) connecting an electrically operated solenoid between said first and second ends of said electrical wire;

(c) connecting a ball retainer to said solenoid for retaining balls conformed to plug a strainer, when released into flowing drilling fluid;

(d) connecting said strainer, through which drilling fluid flows when pumped, to said drill string between said ball retainer and said bottom hole assembly;

(e) providing a one way pressure relief means in said drill string conformed to operate only when the flow of drilling fluid is continued after said strainer is blocked by said balls;

(f) providing a moveable piston conformed to said drill string and moveable to apply pressure to move a disconnect shift tube holding said coupling key in place;

(g) transmitting a signal from said surface signal generator to said electrically operated solenoid thereby releasing said balls into said drilling fluid; and (h) continuing the flow of said drilling fluid after said strainer has been plugged by said balls so that said one way pressure relief means operates, allowing drilling fluid to move said moveable piston, thereby applying pressure to move said disconnect shift tube so as to shift said disconnect shift tube and release said coupling key, thereby uncoupling said inner and outer coupling housing and releasing said remote bottom hole assembly from said drill string.

* * * * *